United States Patent [19]

McCarthy

[11] Patent Number: 4,523,390

[45] Date of Patent: Jun. 18, 1985

[54] PERIPHERAL EXHAUST SYSTEM FOR HIGH VELOCITY DRYER

[75] Inventor: Richard A. McCarthy, Ramsey, N.J.

[73] Assignee: Aer-Overly Corporation, Ramsey, N.J.

[21] Appl. No.: 449,545

[22] Filed: Dec. 13, 1982

[51] Int. Cl.[3] ..... F26B 13/08

[52] U.S. Cl. ..... 34/115; 34/122; 34/155; 34/216

[58] Field of Search ..... 34/114, 122, 155, 156, 34/160, 212, 213, 216, 220

[56] References Cited

U.S. PATENT DOCUMENTS 2,268,988 1/1942 Hess et al. ..... 34/122

3,377,056 4/1968 Boye ..... 34/122

4,064,637 12/1977 Lindgren ..... 34/122

*Primary Examiner*—Larry I. Schwartz

*Attorney, Agent, or Firm*—Shenier & O'Connor

[57] ABSTRACT

In a peripheral exhaust system for a high velocity dryer having dryer hood sections and respective supply and removal ducts associated with each section through which recirculating air used for drying is carried to and away from the sections, auxiliary exhaust ducts formed along the periphery of the sections adapted to receive a portion of the hot air used for drying that would otherwise enter the area surrounding the dryer hood and a portion of the cold air from the surrounding area that would otherwise enter the dryer hood. The exhaust ducts are connected by blowers to ducts which remove the air to a location remote from the web.

3 Claims, 8 Drawing Figures

Fig 5
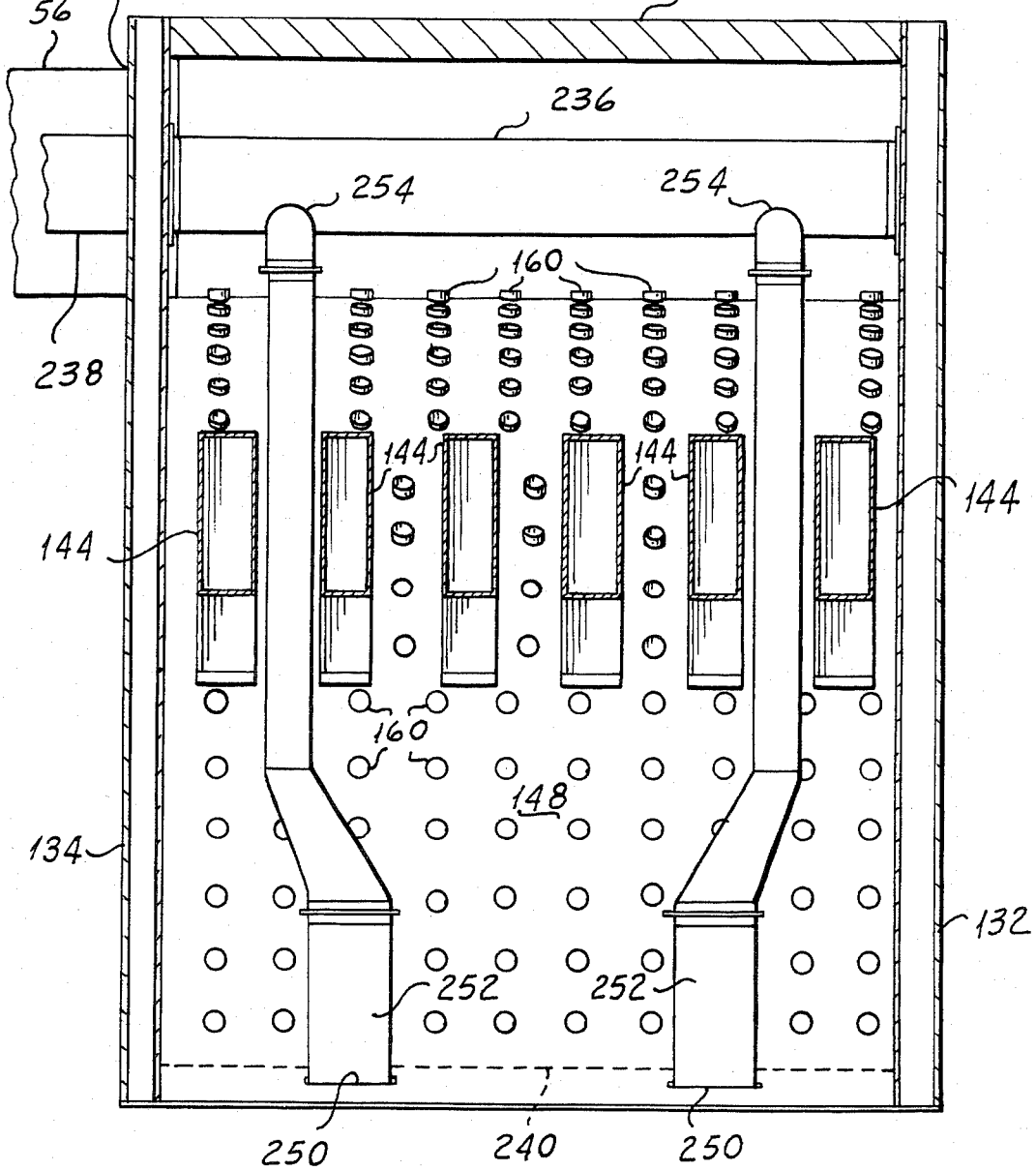
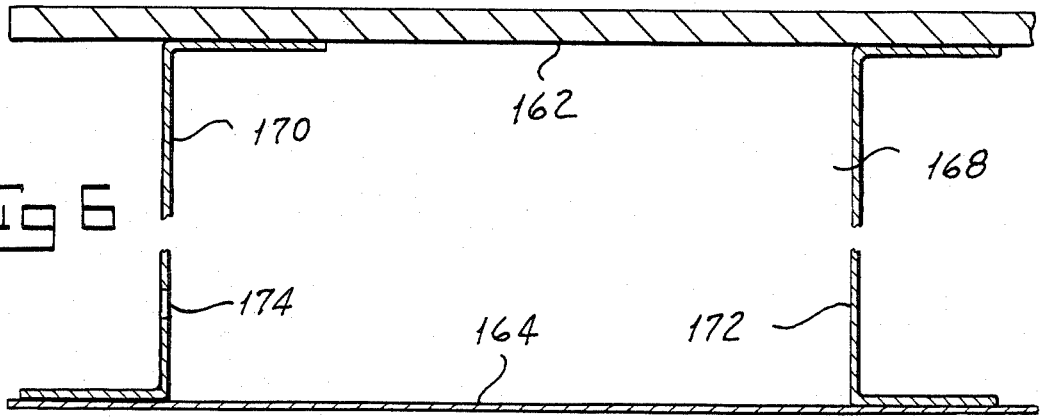
Fig 6

PERIPHERAL EXHAUST SYSTEM FOR HIGH VELOCITY DRYER

FIELD OF THE INVENTION

My invention relates to high velocity dryers and more particularly to a peripheral exhaust system for a Yankee dryer.

BACKGROUND OF THE INVENTION

There are known in the prior art various high velocity dryers for drying the web formed in the course of making paper on a paper-making machine. In one such high velocity dryer, the web to be dried is passed over a dryer cylinder, the major portion of the periphery of which is enclosed by a hood. Hot drying air is supplied to the hood and is directed against the surface of the web and is then removed from the hood. Most of the systems are recirculating systems in which a certain portion of the air removed from the hood is returned thereto together with an amount of fresh air heated to supply air temperature.

High velocity drying equipment used in the tissue and toweling industries, operates at supply air temperatures as high as 900° F. The design of the supply systems of these dryers has been pointed toward minimizing the exhaust volumes in order to produce the highest drying capabilities at the lowest fresh air heating requirements. As a result the total energy consumption of these systems has decreased substantially. These systems now operate at exhaust humidities of approximately 0.4 pounds of water per pound of dry air, which is a reasonable minimum energy consumption.

The fresh air requirements when a system, such as a Yankee dryer, is operating at a low exhaust volume consists primarily of the air required by the burners to provide oxygen for combustion and the infiltration air required around the periphery of the dryer. This infiltration air is necessary as it is practically impossible to perfectly balance the dryer in such a way as to prevent the intrusion of the hot moist air used for drying into the working area surrounding the dryer. To prevent such intrusion the drying system is run so that air from the area surrounding the hood is drawn into the drying system along the periphery. While the quantity of the cold air infiltrated is rather small, the energy required to heat this air from room temperature to exhaust temperatures represents approximately 15% of the total energy consumption of the system.

In addition, the infiltrated air often results in edge effects from cold air entering the dryer causing uneven drying. Because this infiltration air is spread along the entire periphery of the drying system, it is impossible to eliminate this heat load by means of heat recovery equipment.

SUMMARY OF THE INVENTION

One object of my invention is to provide a peripheral exhaust system for a high velocity dryer which substantially reduces both the spillout of the hot moist air used for drying from the periphery of the dryer into the surrounding area, and the amount of infiltration air drawn into the periphery of the dryer from the surrounding area.

Another object of my invention is to provide a peripheral exhaust system for a high velocity dryer in which waste heat from the drying system is used to preheat the infiltration air.

Still another object of my invention is to provide a peripheral exhaust system for a high velocity dryer which reduces heat radiation from the dryer to the surrounding area.

A further object of my invention is to provide a peripheral exhaust system for a high velocity dryer which permits the dryer to operate at a higher recirculation rate than dryers of the prior art.

A still further object of my invention is to provide a peripheral exhaust system for a high velocity dryer which substantially reduces the amount of corrosive vapors drawn into the dryer.

An additional object of my invention is to provide a peripheral exhaust system for a high velocity dryer which permits even drying of the web along the edges.

Other and further objects of my invention will appear from the following description.

BRIEF DESCRIPTION OF THE DRAWINGS

In the accompanying drawings to which reference is made in the instant specification and in which like reference characters are used to indicate like parts in the various views:

FIG. 3 is a rear end elevation of the hood section of the dryer shown in FIG. 1 with parts broken away.

FIG. 5 is a section of the dry end hood section taken along the lines 5—5 of FIG. 2.

FIG. 6 is an enlarged fragmentary section of the front end plate assembly of the wet end hood section taken along the lines 6—6 of FIG. 4.

DESCRIPTION OF THE PREFERRED EMBODIMENT

Figure 1:
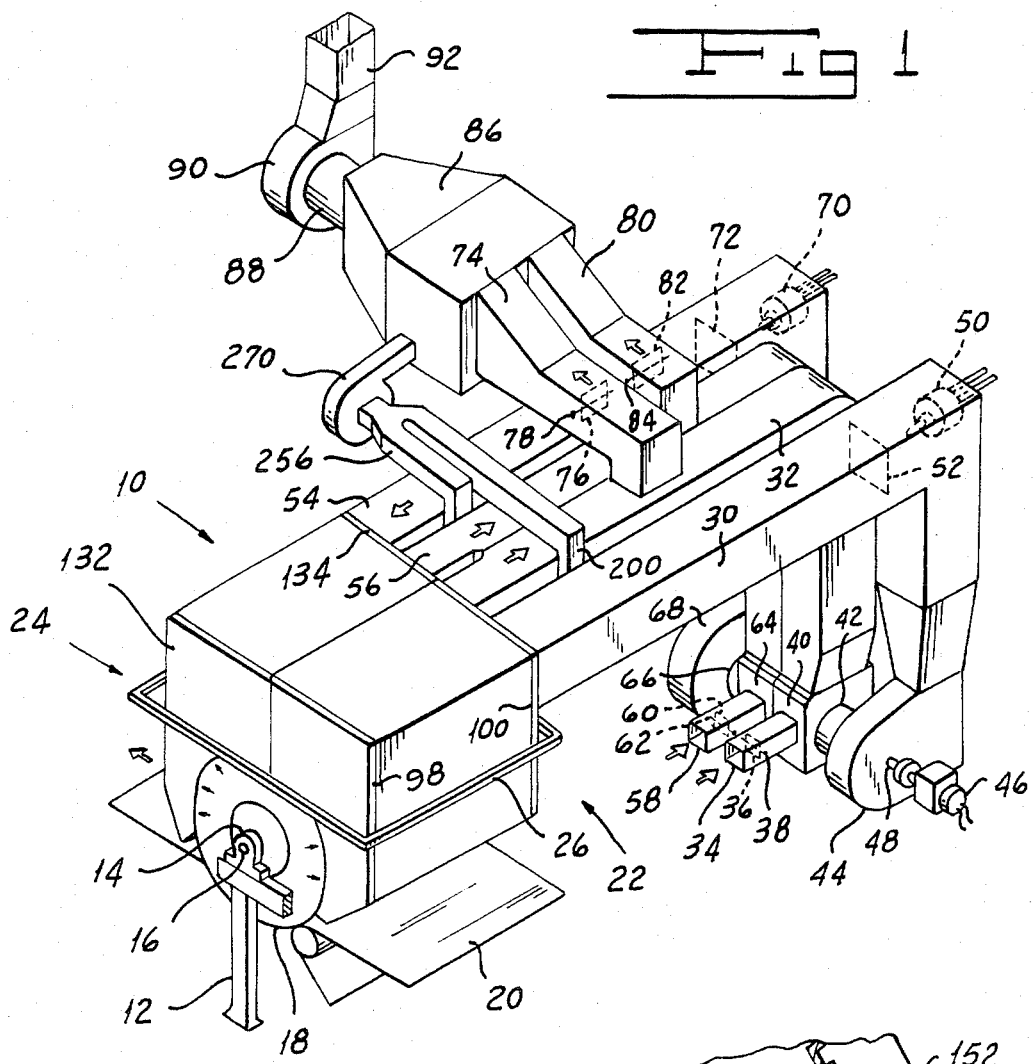
FIG. 1 is a partially schematic, perspective view of a typical Yankee dryer installation provided with one embodiment of my peripheral exhaust system for a high velocity dryer.

Referring now to FIG. 1 of the drawings, one type of high velocity paper machine dryer with which my peripheral exhaust duct system is especially adapted to be used, is a Yankee dryer indicated generally by the reference character 10, in which a frame 12 carries a bearing block 14, which rotatably supports the shaft 16 of a dryer roll 18. The web 20 of paper to be dried is guided around the major portion of the periphery of the dryer roll 18 in a manner known to the art.

The dryer 10 includes a hood having a movable wet end section indicated generally by the reference character 22 and a movable dry end section indicated generally by the reference character 24. A subframe 26 supports each of the sections 22 and 24.

A wet end air inlet or supply duct 30 is adapted to supply drying air to the section 22 in a manner to be described. After the drying air supplied to the section 22 has been directed against the surface of the web 20, it is removed from the wet end of the hood by a return or exhaust duct 32. A wet end fresh air inlet duct 34 is adapted to supply a predetermined amount of fresh air to the wet end. In order to control the amount of dry air being fed into the wet end, duct section 34 is provided with a baffle 36 having a shaft 38 which may be positioned so as to regulate the amount of fresh air moving into the duct 34. Duct 34 leads into a mixing chamber 40 which also receives an input from the return duct 32 associated with the wet end 22. An outlet pipe 42 from the chamber 40 provides the input to a blower 44 adapted to be driven by the shaft 48 of a motor 46 in a manner known to the art. The output of the blower 44 provides the input to the duct 30. The mixture of fresh air and recirculating air which makes up the output of the blower 44, moves past a burner 50 and a screen 52 in the course of its movement toward the hood section 22. As is known, the burner 50 heats this inlet air to a predetermined degree.

The dry end 24 of the dryer 10 includes a dry end inlet duct 54 through which drying air is supplied to the hood section 24 so as to be brought into contact with the portion of the web 20 on the roll 18 within the section. A dry end return duct 56 carries air away from the section 24 after it has contacted the web. A dry end fresh air inlet duct 58 is provided with a baffle 60 having a shaft 62 which is so positioned as to regulate the amount of fresh air being fed into the dry end of the system. Duct 58 leads into a mixing chamber 64 which is also fed by the return duct 56. The mixing chamber outlet pipe 66 provides the input to the dry end blower 68 which is driven by a motor (not shown) so as to supply drying air to the inlet duct 54. Air moving into the duct 54 travels past a burner 70 and a screen 72, which heat the drying air to a predetermined temperature.

A wet end air removal duct 74 is provided with a baffle 76 and a shaft 78 which may be positioned so as to regulate the amount of air being removed from the wet end of the machine. A dry end air removal duct 80 has a baffle 82 provided with a shaft 84 which may be positioned so as to regulate the amount of air being removed from the dry end of the machine. Both the ducts 74 and 80 lead through a chamber 86 into the inlet pipe 88 of a blower 90, the output of which leads to the main air removal duct 92 of the dryer.

Figure 2:
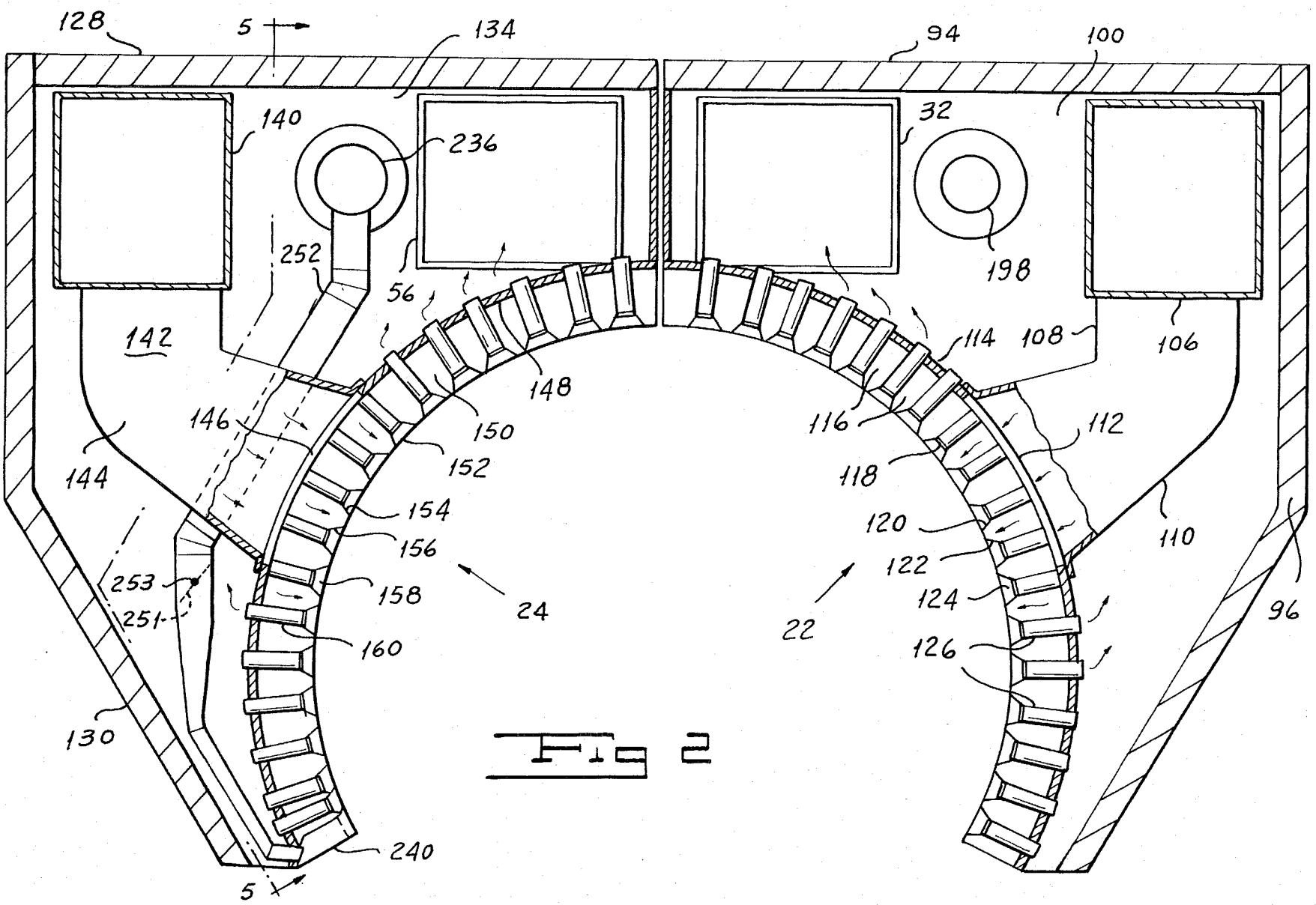
FIG. 2 is a sectional elevation of the hood section of the dryer shown in FIG. 1, with some parts broken away.
Figure 1:
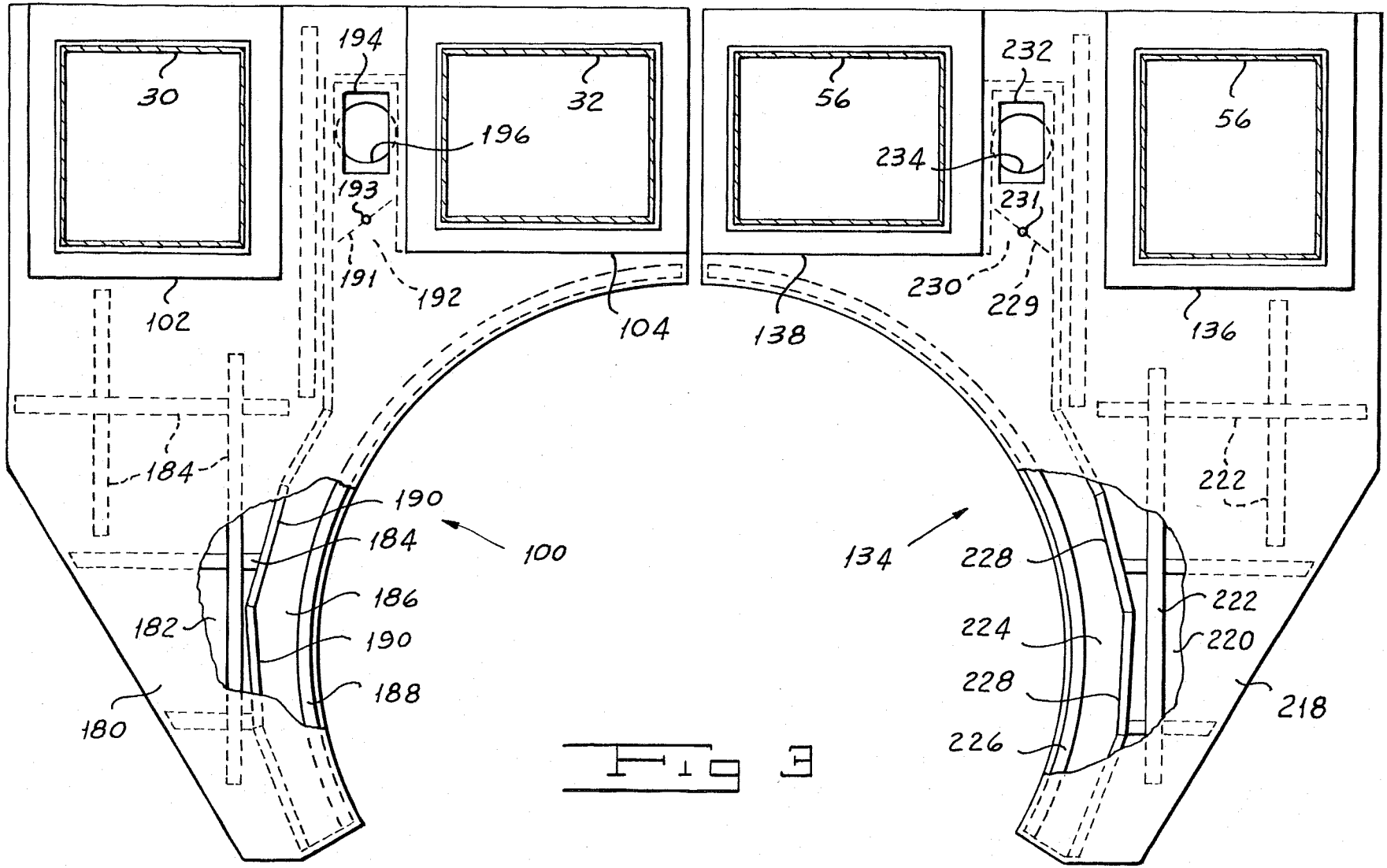
Figure 4:
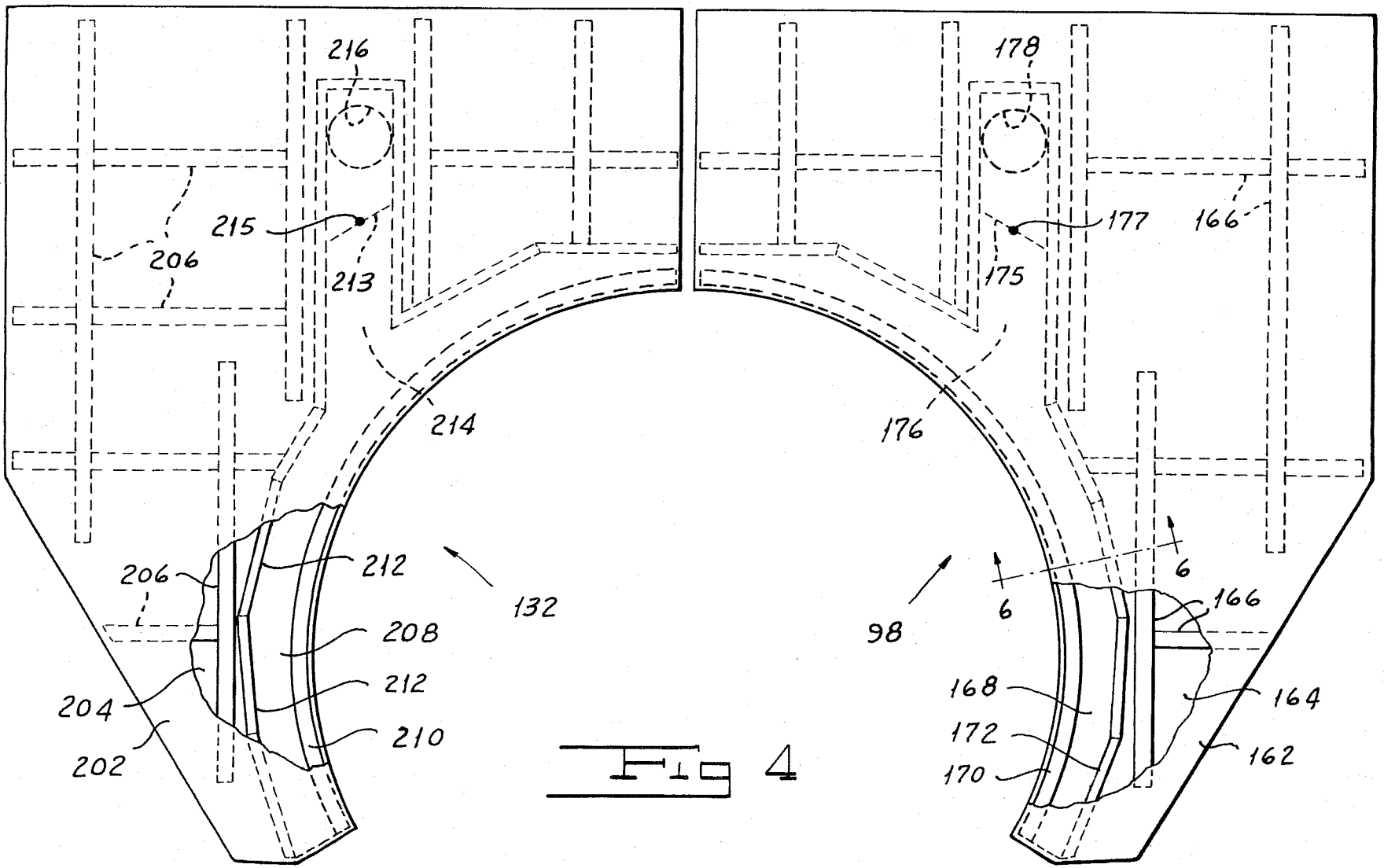
FIG. 4 is a front end elevation of the hood section of the dryer shown in FIG. 1 with parts broken away.

Referring now to FIGS. 2, 3 and 4, the wet end section 22 of the hood includes a top 94, a side 96 and respective front and rear end double walls 98 and 100 to be described more fully hereinbelow. The wet end air supply duct 30 extends into the interior of wet end section 22 through a supporting frame 102 in rear end wall 100. The wet end air exhaust duct 32 extends into the interior of section 22 through a supporting frame 104 in end wall 100. I connect supply duct 30 to a distributing header 106 extending across the width of the section 22. Respective distributor connections 108 carry air from the header 106 to respective lead-in connections 110 which direct air through openings 112 in one arcuate wall 114 of each of a number of inner high pressure air chambers 116 distributed across the section 22. Partitions 124 separate chambers 116. The other wall of each of the chambers 116 is made up of a plurality of members 118 which extend between an end wall 98 or 100 and a partition 124 or between a pair of partitions 124. Each of the members 118 has a cross-sectional shape generally in the form of an inverted U, the legs 120 and 122 of which diverge slightly so that pairs of adjacent legs form a plurality of elongated transversely extending nozzles, spaced circumferentially of the roll for directing jets of high velocity air onto the surface of the web 20.

Adjacent each of the connecting ducts 108, I provide a respective damper (not shown) which may be controlled from the exterior of section 22 to permit the supply of air provided by that particular duct to be varied. In this way I am able to regulate the air supplied to the web 20 over a plurality of narrow sections across its width so as to ensure that drying occurs evenly across the width of the web.

The transversely elongated jets of high velocity air emanating from the nozzles formed by legs 120 and 122 are directed into the surface of the web 20 so as to provide a scrubbing action thereat. I provide means for carrying away air bearing moisture which has been removed from the web by the scrubbing action referred to above. A plurality of short lengths of tubing or ports 126 extend through members 118 at locations between the nozzles, through the chambers 116 and through the wall 114 of chambers 116 to the space within the hood section outside the high pressure air chambers 116. As has been explained above, the wet end exhaust duct 32 leads into this space to permit the return air to be carried out of the wet end hood section 22. It will readily be appreciated that there are no return tubes 126 in the region wherein high velocity air is introduced by the lead-in connections 110 of the distributing header 106.

Referring now to FIGS. 2 to 5, the dry end section 24 of the hood includes a top 128, a side 130 and respective front and rear end double walls 132 and 134 to be described more fully hereinbelow. The dry end air supply duct 54 extends into the interior of dry end section 24 through a supporting frame 136 in rear sideplate 134. The dry end air exhaust duct 56 extends into the interior of section 24 through a supporting frame 138 in side plate 34. I connect supply duct 54 to a distributing header 140 extending across the width of section 24. Respective distributor connections 142 carry air from the header 140 to respective lead-in connections 144 which direct air through openings 146 in one arcuate wall 148 of each of a number of inner high pressure air chambers 150 distributed across the section 24. Partitions 158 separate chambers 150. The other wall of each of the chambers 150 is made up of a plurality of members 152 which extend between an end wall 132 or 134 and a partition 158 or between a pair of partitions. Each of the members 152 has a cross-sectional shape generally in the form of an inverted U, the legs 154 and 156 of which diverge slightly so that pairs of adjacent legs form a plurality of elongated transversely extending nozzles, spaced circumferentially of the roll, for directing jets of high velocity air onto the surface of the web 20.

Adjacent each of the connecting ducts 142, I provide a respective damper, not shown, which may be controlled from the exterior of section 24 to permit the supply of air provided by that particular duct to be varied. In this way I am able to regulate the air supplied to the web 20 over a plurality of narrow sections across its width so as to ensure that drying occurs evenly across the width of the web.

The transversely elongated jets of high velocity air emanating from the nozzles formed by flanges 154 and 156 are directed onto the surface of the web 20 so as to provide a scrubbing action thereat. I provide means for carrying away air bearing moisture which has been removed from the web by the scrubbing action referred to above. A plurality of short lengths of tubing or ports 160 extend through members 152 at locations between the nozzles, through the chambers 150 and through the wall 148 of chambers 150 to the space within the hood section outside the high pressure air chambers 150. As has been explained above, the dry end exhaust duct 56 leads into this space to permit the return air to be carried out of the dry end hood section 24. It will readily be appreciated that there are no return tubes 160 in the region wherein high velocity air is introduced by the lead-in connections 144 of the distributing header.

Figure 7:
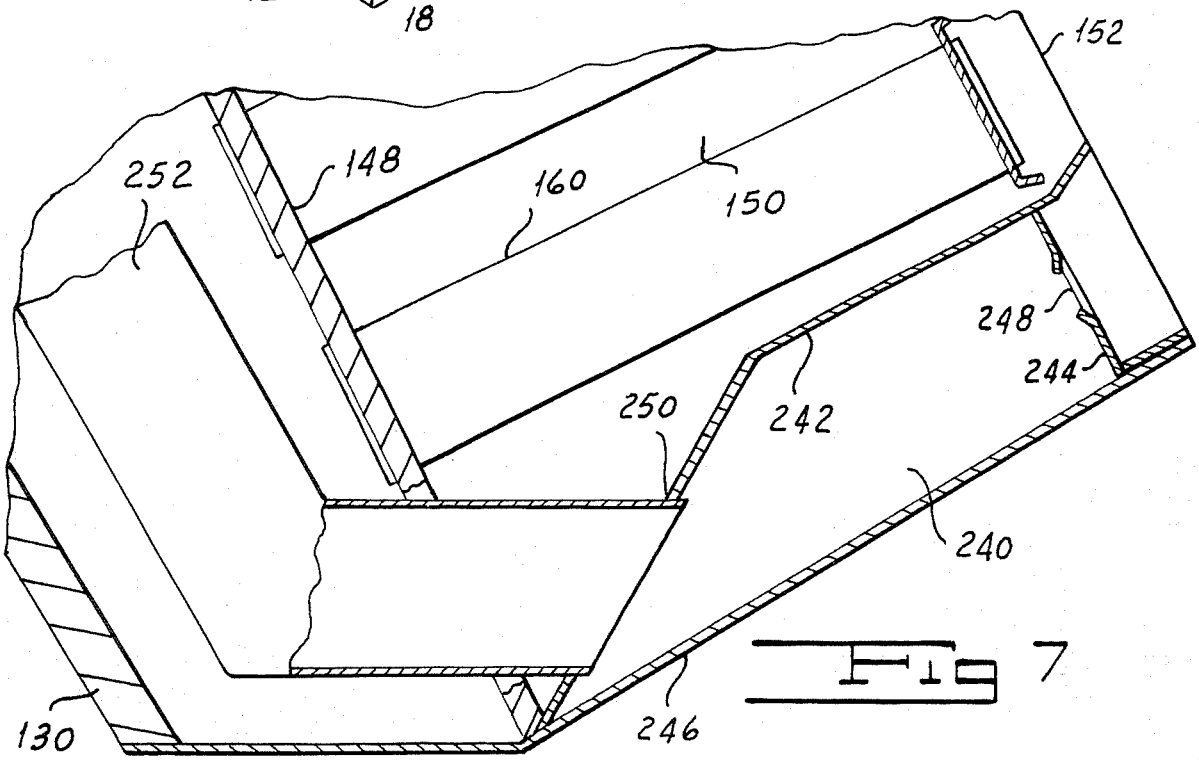
FIG. 7 is an enlarged fragmentary end elevation of a portion of the dry end hood section shown in FIG. 2 with parts shown in section.
Figure 8:
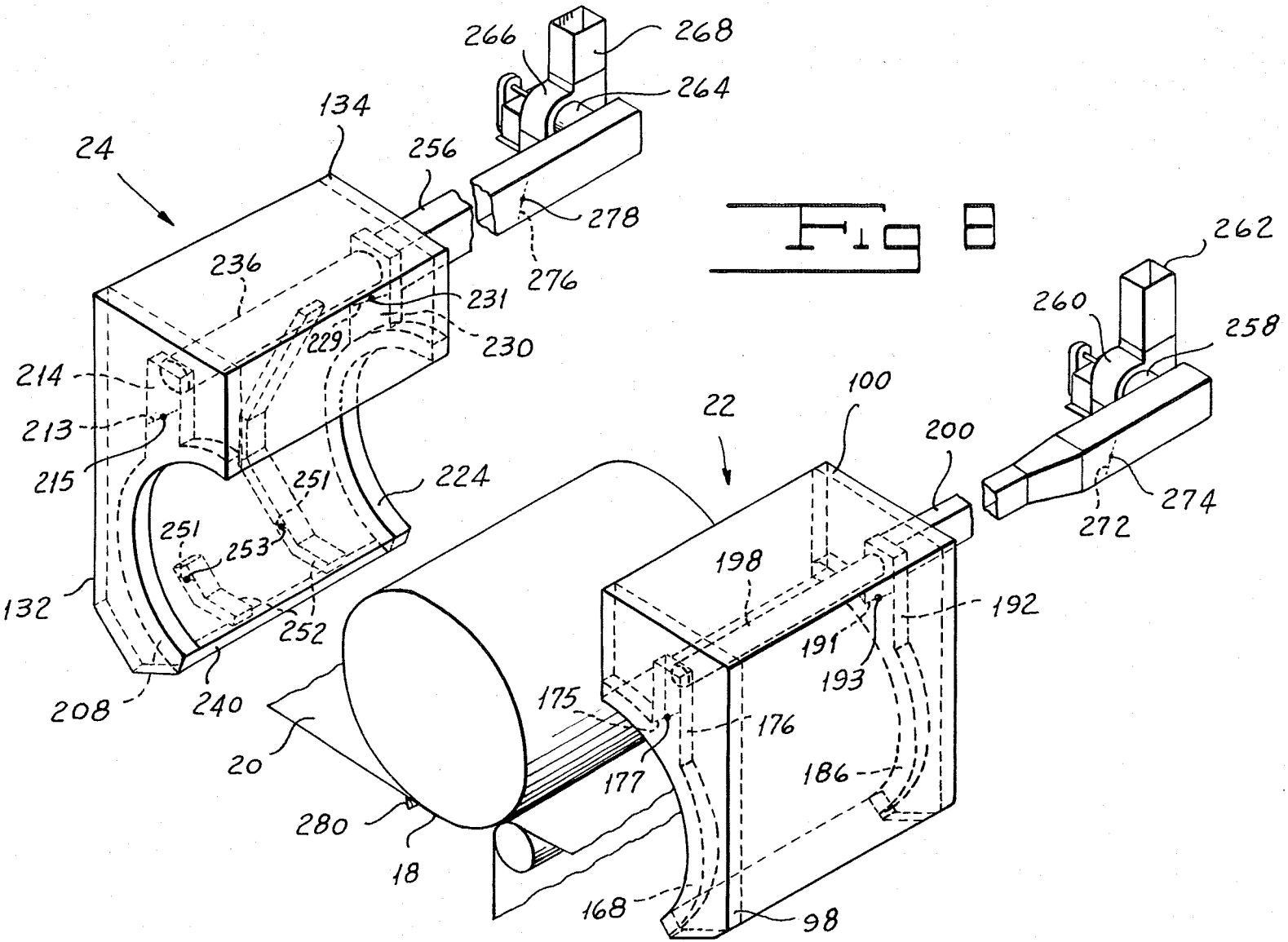
FIG. 8 is a partially schematic perspective view of a hood section of a Yankee dryer provided with another embodiment of my peripheral exhaust system for a high velocity dryer.

Referring now also to FIGS. 6, 7 and 8, I form the front end double wall 98 of wet end section 22 with an exterior wall 162 and an interior wall 164, with a plurality of frame members 166 located therebetween. The interior wall 164 forms the outer wall of the front pressure chamber 116. I form an exhaust duct 168 circumferentially along the periphery of the double wall 98 adjacent the dryer roll 18 at the front end thereof. The duct 168 is formed by an arcuate wall 170 extending between walls 162 and 164 and secured thereto by any suitable means, such, for example, as welding, and by a plurality of wall sections 172 extending between walls 162 and 164 and spaced from wall 170. Wall sections 172 are secured to walls 162 and 164 by any suitable means such, for example, as welding. I provide wall 170 with a plurality of circumferentially spaced openings 174 through which some of the moist air used for drying and air from the surrounding atmosphere is drawn into the duct 168. Wall sections 172 also form an exhaust header lead-in connection 176 through which air from the exhaust duct 168 moves to an opening 178 in the interior wall 164 of double wall 98. Lead-in connection 176 is provided with a baffle 175 and a shaft 177 which may be positioned in a manner to regulate the amount of air removed through duct 168.

I form the rear end double wall 100 of wet end section 22 with an exterior wall 180 and an interior wall 182, held in spaced relationship by a plurality of frame members 184 located therebetween. The interior wall 182 forms the outer wall of the rear pressure chamber 116. I form an exhaust duct 186 circumferentially along the periphery of the double wall 100 adjacent the dryer roll 18 at the rear end thereof. The duct 186 is formed by an arcuate wall 188 extending between walls 180 and 182 and secured thereto by any suitable means, and by a plurality of wall sections 190 also extending between walls 180 and 182 and spaced from wall 188. Wall 188 is formed with a plurality of circumferentially spaced openings through which some of the moist air used for drying and air from the surrounding atmosphere is drawn into the duct 186. Wall sections 190 also form an exhaust duct lead-in connection 192 through which exhaust air from the duct 186 moves to an opening 194 in the exterior wall 180 of double wall 100. Lead-in connection 192 is provided with a baffle 191 and a shaft 193 which may be positioned in a manner to regulate the amount of air removed from duct 186.

I form the interior wall 182 of double wall 100 with an opening 196 adjacent lead-in connection 192 and in alignment with opening 194. A cross header 198 extending across the width of wet end section 22 is connected at one end to opening 178 in the interior wall 164 of front end double wall 98 and at the other end to opening 196 in the interior wall 182 of rear end double wall 100. Exhaust air entering header 198 from duct 168 is adapted to flow through the upper portion of duct 192 and into a wet end peripheral exhaust duct 200, one end of which is connected to opening 194, together with exhaust air from duct 186.

I form the front end double wall 132 of dry end section 24 with an exterior wall 202 and an interior wall 204 held in spaced relationship by a plurality of frame members 206 located therebetween. An exhaust duct 208 extends circumferentially along the periphery of the double wall 132 adjacent the dryer roll 18 at the front end thereof. The duct 208 is formed from an arcuate wall 210 extending between walls 202 and 204 and secured thereto by any suitable means, and by a plurality of wall sections 212 also extending between walls 202 and 204 and spaced from wall 210. Wall 210 is formed with a plurality of circumferentially spaced openings through which some of the moist air used for drying and air from the surrounding atmosphere is drawn into the duct 208. Wall sections 212 also form an exhaust header lead-in connection 214 through which air from the exhaust duct 208 moves to opening 216 in the interior wall 204 of double wall 132. Lead-in connection 214 is provided with a baffle 213 and a shaft 215 which may be positioned in a manner to regulate the amount of air removed from duct 208.

I form the rear end double wall 134 of dry end section 24 with an exterior wall 218 and an interior wall 220, held in spaced relationship by a plurality of frame members 222 located therebetween. An exhaust duct 224 extends circumferentially along the periphery of the double wall 134 adjacent the dryer roll 18 at the rear end thereof. The duct 224 is formed from an arcuate wall 226 extending between walls 218 and 220 and secured thereto by any suitable means, and a plurality of wall sections 228 also extending between walls 218 and 220 and spaced from wall 226 so as to create duct 224 therebetween. Wall 226 is formed with a plurality of circumferentially spaced openings through which some of the moist air used for drying and air from the surrounding atmosphere is drawn into the duct 224. Wall sections 228 also form an exhaust duct lead-in connection 230 through which exhaust air from the exhaust duct 224 moves to an opening 232 in the exterior wall 218 of double wall 134. Lead-in connection 230 is provided with a baffle 229 and a shaft 231 which may be positioned in a manner to regulate the amount of air removed from duct 224.

I form the interior wall 220 of double wall 134 with an opening 234 adjacent lead-in connection 230 and in alignment with opening 232. A cross header 236 extending across the width of the dry end section 24 is connected at one end to opening 216 in the interior wall 204 of double wall 132 and at the other end to opening 234 in the interior wall 220 of double wall 134.

As best seen in FIG. 7, dry end section 24 is also formed with a cross hood exhaust duct 240 extending across the width of the section at the lower end thereof. The duct 240 is located between walls 148 and 152 of section 24, and extends from the front end double wall 132 to the rear end double wall 134. The duct 240 is formed by walls 242 and 244 which extend across the width of the section 24 between the interior walls 204 and 220 of respective end double walls 132 and 134 by a bottom wall 246 of section 24. Wall 244 is formed with a plurality of spaced openings 248 extending transversely of the dryer roll, through which some of the moist air used for drying and air from the surrounding atmosphere is drawn into the duct 240. A plurality of ducts 252 lead from openings 250 in wall 242 to cross header 236 through drop connections 254. Each of the connecting ducts 252 is provided with a baffle 251 and a shaft 253 which may be positioned in a manner to regulate the amount of air removed from exhaust duct 240. Exhaust air entering header 236 from ducts 208 and 240 is adapted to flow through the upper portion of duct 230 and into a dry end peripheral exhaust duct 256, one end of which is connected to opening 232, together with exhaust air from duct 224.

In the embodiment of my invention shown in FIG. 8, wet end peripheral exhaust duct 200 leads into the inlet 258 of an exhaust fan 260, the output of which leads to an exhaust removal duct 262. The dry end peripheral exhaust duct 256 leads into the inlet pipe 264 of an exhaust fan 266, the output of which leads to an exhaust removal duct 268. Both removal ducts 262 and 268 lead out of the work area of the dryer 10 and are completely isolated from the rest of the drying system.

In the embodiment of my invention shown in FIG. 1, I dispense with the separate removal ducts 262 and 268 shown in FIG. 8 and connect both the wet and dry end peripheral exhaust ducts 200 and 256 to the inlet of a blower 270. The output of blower 270 leads through chamber 86 to the inlet pipe 88 of blower 90, which exhausts through the main air removal duct 92 of the dryer 10. It will readily be appreciated that chamber 86 could, for example, house a suitable heat recovery system utilizing the hot exhaust from ducts 74, 80, 200 and 256.

As best seen in FIG. 8, the wet end peripheral exhaust duct 200 is provided with a baffle 272 and a shaft 274 which is positioned in a manner to regulate the amount of air removed from the wet end peripheral exhaust ducts 168 and 186. In addition, as described above, each lead-in connection 176 and 192 includes a baffle and shaft assembly adapted to be positioned to individually regulate the amount of air removed from respective ducts 168 and 186. The dry end peripheral exhaust duct 256 is also provided with a baffle 276 and a shaft 278 which is positioned in a manner to regulate the amount of air removed from the dry end peripheral exhaust ducts 208, 224 and 240. And, as described above, each of the lead-in connections 214, 240 and 252 includes a baffle and shaft assembly adapted to be positioned to individually regulate the amount of air removed from respective ducts 208, 224 and 240.

Normally Yankee dryers and high velocity dryers in general, are balanced to maintain a negative pressure condition around the hood to reduce the spillout of the hot moist air used for drying from the ends of the hood into the working area surrounding the dryer. This is accomplished by regulating the flow of hot air to the wet and dry end sections 22 and 24 of the hood through wet and dry end supply ducts 30 and 54. As a result of this negative pressure condition, some cold air from the area surrounding the hood is picked up along the edges of the hood and moved through the circulating drying system through tubes 126 and 160 and wet and dry end exhaust ducts 32 and 56. This infiltration air is then heated by burners 50 and 70 to the supply air temperature which, for many high velocity dryers, is approximately 900° F.

Dryer 10 which is equipped with my peripheral exhaust system, may be balanced to provide a positive pressure condition around the hood so as to promote spillout of the hot moist air used for drying into the working area surrounding the hood. This is accomplished by increasing the air flow to the hood through supply ducts 30 and 54 and results in a substantial decrease in the amount of infiltration air picked up along the edges of the hood and moved through the circulating drying system through the main exhaust ducts 32 and 56. The excess hot moist air, however, does not spill out into the working area surrounding the hood, but is drawn into the peripheral exhaust ducts 98, 100, 132, 134 and 240 along the edges of the hood, together with cold air from the surrounding atmosphere. This mixture of cold air and hot moist air which may also contain corrosion causing chemical laden vapors is removed through ducts 200 and 256 either through exhaust removal ducts 262 and 268 as shown in FIG. 8 or through the main air removal duct 92 of the dryer 10 as shown in FIG. 1. In either embodiment of my invention, it will be seen that the peripheral exhaust is isolated from the circulating drying system formed by the hood supply ducts 30 and 54 and the exhaust ducts 32 and 56.

It will be readily appreciated that a substantial reduction in infiltration air entering the drying system corresponds to a reduction in the amount of air to be heated to supply air temperature by burners 50 and 70. This decrease in infiltration air lessens the occurrence of edge effects from cold air entering the system, to provide even drying of the web at the edges. The reduced amount of infiltration air that actually enters the circulating system is preheated somewhat by the moist hot air which is returned through tubes 126 and 160 and ducts 32 and 56. A higher recirculation rate and exhaust humidity is also achieved as a good portion of the infiltration air that would normally enter the drying system is replaced by the moist hot air used for drying.

Yankee dryers are also normally provided with some form of insulation system, often utilizing a quantity of through metal, to cool certain areas of the hood which become very hot during normal use. This is to prevent heat radiation from the hood into the surrounding work area.

Dryer 10, however, does not require such an insulation system as my peripheral exhaust system provides a moving air stream to cool the front end walls 98 and 132 and the rear end walls 100 and 134 of the wet and dry end sections 22 and 24 to prevent heat radiation into the surrounding work area. In addition, the cross hood duct 240, located at the dry end section 24 tail, prevents both spillout and heat radiation in the are of the doctor blade 280. This is desirable as the blades must be changed periodically by the operator.

It will be seen that I have accomplished the objects of my invention. I have provided a peripheral exhaust system for a high velocity dryer which substantially reduces both the spillout of the hot moist air used for drying from the periphery of the dryer into the surrounding area, and the amount of infiltration air drawn into the periphery of the dryer from the surrounding area. My peripheral exhaust system permits waste heat from the drying system to be used to preheat the infiltration air and allows the dryer to operate at a higher recirculation rate than dryers of the prior art. In addition my peripheral exhaust system reduces both the amount of heat radiation from the dryer to the surrounding area and the amount of corrosive vapors drawn into the dryer. My peripheral exhaust system for a high velocity dryer also permits even drying of the web along its edges.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A dryer section for drying a web of material including in combination a recirculating drying air system comprising means for supplying heated drying air to an area of said web bounded by the effective periphery of said dryer section, means for removing moisture laden air from said area within said periphery, and means for balancing said supplying and removing means to provide an excess of air tending to flow outwardly of said periphery and means including duct means independent of said recirculating system for carrying said excess air away to a location remote from the working space surrounding said dryer section.

2. Yankee dryer apparatus including in combination a generally cylindrical roll over which a web to be dried passes from an entry location adjacent to the bottom of the roll to an exit location adjacent to the bottom of the roll means mounting said roll for rotary movement around an axis extending from end to end of said roll, wet and dry end dryer sections for covering said roll between its ends over areas extending respectively from said entry location to a location adjacent to the top of the roll and from said exit location to a location adjacent to the top of said roll, a recirculating dry air system comprising means for supplying drying air to each of said sections, distributor means in each of said sections for directing said drying air against said web over said areas, means for removing moisture laden air from said web over said areas, and means for balancing said air supplying and removing means to provide an excess of air tending to flow out of said sections at said ends of said roll, means forming pairs of auxiliary ducts in each of said rolls, each of said auxiliary ducts extending along an edge of one of said areas adjacent to an end of the roll from one of said entry and exit locations to a location adjacent to the top of the roll, and means independent of said recirculating system for carrying said excess air away from the working space surrounding said dryer through said auxiliary ducts.

3. Apparatus as in claim 2 which further includes means forming an auxiliary duct in said dry end dryer section adjacent to said exit location.

* * * * *